United States Patent [19]

Matsui

[11] 4,433,605

[45] Feb. 28, 1984

[54] FIXTURE FOR STRING RETAINER OF THE STRINGS

[75] Inventor: Kazuhiro Matsui, Toyoake, Japan

[73] Assignee: Hoshino Gakki Co., Ltd., Nagoya, Japan

[21] Appl. No.: 363,606

[22] Filed: Mar. 30, 1982

[30] Foreign Application Priority Data

Aug. 5, 1981 [JP] Japan ..... 56-116425[U]

[51] Int. Cl.[3] ..... G10D 3/12

[52] U.S. Cl. ..... 84/299

[58] Field of Search ..... 84/267, 298, 299, 307, 84/297 R, 314 R, 314 N

[56] References Cited

U.S. PATENT DOCUMENTS

| | | | |
|---|---|---|---|
| 2,397,289 | 3/1946 | Proll | 84/297 R |
| 2,491,991 | 12/1949 | Lundback | 84/307 |
| 3,018,680 | 1/1962 | Paul | 84/307 X |
| 3,605,545 | 9/1971 | Rendell | 84/307 |
| 4,230,014 | 10/1980 | Hoshino | 84/299 |

*Primary Examiner*—Lawrence R. Franklin

*Attorney, Agent, or Firm*—Armstrong, Nikaido, Marmelstein & Kubovcik

[57] ABSTRACT

A fixture apparatus for a string retainer for securely fixing a height adjustable, string retainer by holding the string retainer between a fixing bolt and an adjusting bolt and keeping them in contact with the upper and the lower surfaces of the retainer and securing these bolts into an embedded nut having two female threads corresponding to respective bolts.

4 Claims, 8 Drawing Figures

FIXTURE FOR STRING RETAINER OF THE STRINGS

BACKGROUND OF THE INVENTION

1. Field of the Invention

The present invention relates to a fixture for a string retainer for the strings of a guitar or the like. More specifically, the invention relates to a fixture for a string retainer for fixing the string retainer which retains the end or the middle portion of the string and which permits adjustment of the height of the string.

2. Description of the Prior Art

In the prior art, in order to adjust the height of the strings, e.g., in an electric guitar, as shown in FIGS. 1 and 2, a tail piece 2 or a bridge 3 is fixed to a body of the guitar by screwing an adjustment screw 5 having a large-diameter male thread portion 5*a* on the lower portion and a small-diameter male thread portion 5*b* on the upper portion into an embedded nut 4 in the body 1. The screw 5 is loosely inserted into a fixing hole 7 of the tail piece 2 and a nut 6 is screwed onto the small-diameter male thread portion 5*b* projecting from the fixing hole 7.

The moving of the tail piece 2 or the bridge 3 has been carried out by unloosening the nut 6 and the screw 5, moving the screw to the upper portion and tightening the nut 6 again (FIG. 3).

The tail piece 2 or the bridge 3 are securely fixed against the screw 5, being held by the nut 6, however, since there is a manufacturing clearance between the embedded nut 4 and the screw 5, the tail piece or the bridge cannot be securely fixed against the body 1 of the guitar. Therefore, in the tail piece, the string and retainer and in the bridge, the string middle portion retainer, tension of the string and the height of the string become unsteady, thereby producing problems in the acoustics.

SUMMARY OF THE INVENTION

An object of the present invention is to provide a fixture for a string retainer which maintains steady string tension and permits adjusting the height of the string.

Another object of the present invention is to provide a fixture apparatus for a string retainer for securely fixing a height adjustable, string retainer by holding the string retainer between a fixing bolt and an adjusting bolt and keeping them in contact with the upper and the lower surfaces of the retainer and securing these bolts into an embedded nut having two female threads corresponding to respective bolts.

The present invention relates to a fixture for a height adjustable, string retainer comprising an embedded nut having a large-diameter female thread cut on the upper portion and a small-diameter female thread cut on the lower portion in the longitudinal direction, a fixing bolt having a male thread corresponding to the small-diameter female thread inserted into a fixing hole in the string retainer, with the head of the bolt being in contact with the upper surface of the fringe of the fixing hole and an adjusting bolt having a male thread corresponding to the large-diameter female thread cut with the upper surface of the bolt being in contact with the lower surface of the fringe of the fixing hole of the string retainer.

DESCRIPTION OF THE PREFERRED EMBODIMENTS

Figure 1:
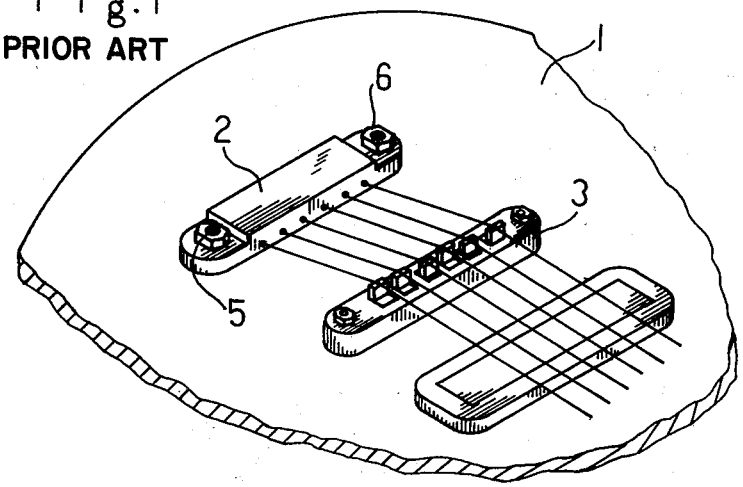
Fig. 1 PRIOR ART
FIG. 1 is a perspective view of an embodiment of a tail piece and a bridge of a guitar as an example of a prior art string retainer.
Figure 2:
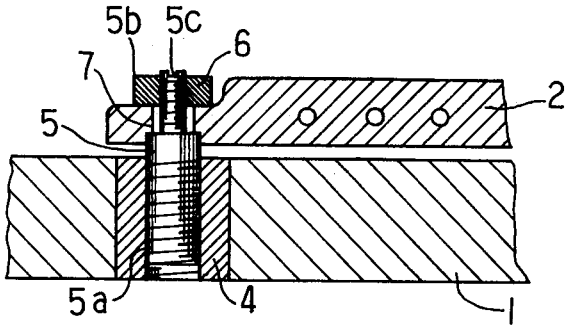
Fig. 2 PRIOR ART
FIG. 2 is a sectional view showing the fixed state of the tail piece to the guitar.
Figure 3:
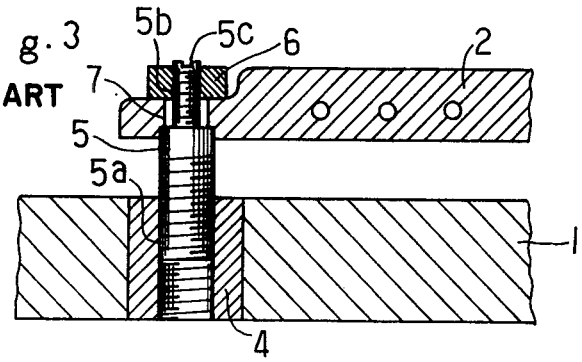
Fig. 3 PRIOR ART
FIG. 3 is a sectional view showing the fixed state when the tail piece shown in FIG. 2 is adjusted for the height of the string.
Figure 4:
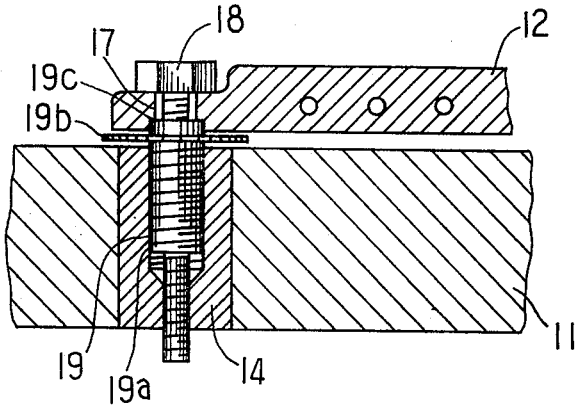
FIG. 4 is a sectional view showing the fixed state of a tail piece to a guitar according to an embodiment of the present invention.

Referring to the drawings, FIG. 4 is a sectional view showing the manner in which a tail piece 12 is fixed to a body of a guitar 11.

Figure 5:
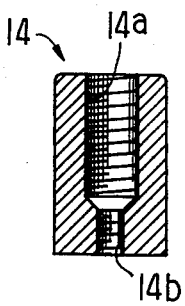
FIG. 5 is a sectional view of an embedded nut according to an embodiment of the present invention.

In FIG. 5, an embedded nut 14 fixed in the body of the guitar 11 has knurling on the outer circumference. On the upper portion of the inner circumference of the embedded nut 14, a female thread 14*a* is cut into the large-diameter bore.

Figure 6:
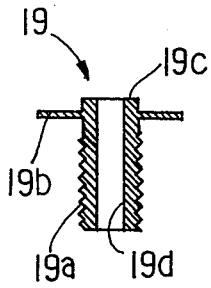
FIG. 6 is a sectional view of an adjusting bolt of an embodiment according to the present invention.

In FIG. 6, an adjusting bolt has a male thread 19*a* cut on the lower portion of the bolt for engaging with the female thread 14*a* on the surface of a large-diameter bore of the embedded nut. The bolt 19 has a flange 19*b* with knurling on the upper portion of the outer circumference, and the upper surface 19*c* of the bolt keeps in contact with the lower surface of the fringe of a fixing hole 17 of the tail piece. An inserting through hole 19*d* is vertically positioned for receiving a fixing bolt 18.

Figure 7:
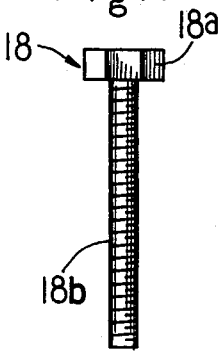
FIG. 7 is a sectional view of a fixing bolt of an embodiment according to the present invention.

The fixing bolt 18 has a head portion 18*a* in contact with the upper surface of the fringe of the fixing hole 17 of the tail piece and is provided with a male thread 18*b* corresponding to a small-diameter female thread 14*b* of the embedded nut on the lower portion of the bolt (FIG. 7). The male thread 18*b* is screwed into the small-diameter female thread 14*b* of the embedded nut through the fixing hole 17 and the inserting through hole 19*d* of the adjusting bolt.

Figure 8:
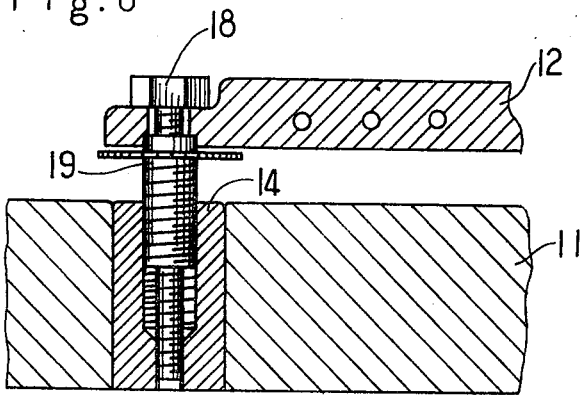
FIG. 8 is a sectional view showing the fixed state when the tail piece shown in FIG. 4 is adjusted for the height of the string.

As shown in FIG. 8, when adjusting the height of the string of the tail piece 12, the fixing bolt 18 is loosened to a given position, the adjusting bolt 19 is loosened to a particular position and the tail piece 12 is pushed up. The fixing bolt 18 is then tightened and the tail piece 12 can be moved and fixed to the body of the guitar.

The tail piece 12 keeps the upper surface of the fringe of the fixing hole 17 in contact with the lower surface of the head portion 18*a* of the fixing bolt and keeps the lower surface of the fringe of the fixing hole 17 in contact with the upper surface 19*c* of the adjusting bolt. The fixing bolt 18 is screwed into the small-diameter female thread 14*b* of the embedded nut and the adjusting nut 19 is screwed into the large-diameter female thread 14*a* of the embedded nut. Therefore, even if manufacturing clearances develop between the fixing bolt 18, the adjusting bolt 19 and the embedded nut 14, since the fixing bolt 18 and the adjusting bolt 19 hold the tail piece 12 by maintaining contact with its upper and the lower surfaces while being fixed into the embedded nut 14 through the different female thread, not only is the tail piece 12 perfectly held between the fixing bolt 18 and the adjusting bolt 19, but the adjusting bolt 19 is tightened against the body 11 of the guitar, thereby securely fixing the tail piece to the body of the guitar.

In the drawings, the fixing construction has been described in relation to a tail piece. However, any type of string retainer in which it is necessary to adjust the height of the strings can be fixed in the same way.

Further, although a hexagonal-head bolt has been used for the fixing bolt, a round screw, a flat screw or the like may be used.

I claim:

1. A fixture apparatus for fixing a string retainer to the body of a musical instrument and for adjusting the height of the string retainer, said device comprising:

(a) an embedded nut fixed to said body, said embedded nut having a large-diameter female thread on the upper portion and a small-diameter female thread on the lower portion;

(b) a fixing bolt having a male thread corresponding to said small-diameter female thread, inserted into a fixing hole in said string retainer, wherein a head portion of said bolt contacts the upper surface of a fringe of said fixing hole; and (c) an adjusting bolt having a male thread corresponding to said large-diameter female thread and having an inserting through hole in the center thereof, wherein the upper surface of said adjusting bolt contacts with the lower surface of the fringe of said fixing hole, said adjusting bolt being screwed into said embedded nut, and wherein said string retainer is positioned to keep the lower surface of the fringe of said fixing hole in contact with the upper surface of said adjusting bolt, and said fixing bolt is screwed into said embedded nut, passing through said inserting through hole of said adjusting bolt, whereby said string retainer is held between said fixing bolt and said adjusting bolt and fixed to the body of said musical instrument.

2. A fixture apparatus for a string retainer as claimed in claim 1, wherein said adjusting bolt has a disc type flange portion thereupon.

3. A fixture apparatus for a string retainer as claimed in claim 1 or 2, wherein said string retainer is a tail piece of a guitar.

4. A fixture apparatus for a string retainer as claimed in claim 1 or 2, wherein said string retainer is a bridge of a guitar.

* * * * *